US006776438B2

(12) United States Patent
Lee

(10) Patent No.: US 6,776,438 B2
(45) Date of Patent: Aug. 17, 2004

(54) MAGNETIC PRINTING MEDIA FOR INKJET AND LASERJET

(75) Inventor: Brian Craig Lee, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/920,207

(22) Filed: Aug. 1, 2001

(65) Prior Publication Data

US 2003/0025321 A1 Feb. 6, 2003

(51) Int. Cl.[7] ..... B42D 15/00

(52) U.S. Cl. ..... 283/82; 235/493; 283/67; 283/72; 283/81

(58) Field of Search ..... 235/493; 283/81, 283/82, 94, 67, 72, 113; 428/900, 915, 916

(56) References Cited

U.S. PATENT DOCUMENTS

| | | | | |
|---|---|---|---|---|
| 3,683,382 A | | 8/1972 | Ballinger | |
| 4,114,032 A | | 9/1978 | Brosow et al. | |
| 4,186,944 A | | 2/1980 | Pearce | |
| 4,262,312 A | | 4/1981 | Fukuda et al. | |
| 4,668,586 A | | 5/1987 | Kohl et al. | |
| 4,687,705 A | | 8/1987 | Miyatsuka et al. | |
| 4,844,991 A | | 7/1989 | Miura et al. | |
| 4,884,081 A | | 11/1989 | Fukushima et al. | |
| 4,929,821 A | | 5/1990 | Kocznar et al. | |
| 5,382,963 A | | 1/1995 | Pond et al. | |
| 5,424,523 A | * | 6/1995 | Ohno et al. | 235/449 |
| 5,427,842 A | * | 6/1995 | Bland et al. | 428/213 |
| 5,747,156 A | * | 5/1998 | Hashiba et al. | 283/82 |
| 5,764,429 A | * | 6/1998 | Fassler et al. | 235/493 |
| 5,808,637 A | | 9/1998 | Wenzel et al. | |
| 5,916,673 A | | 6/1999 | Fryberg et al. | |
| 6,110,584 A | | 8/2000 | Hiratsuka et al. | |
| 6,183,851 B1 | | 2/2001 | Mishima | |
| 6,187,439 B1 | | 2/2001 | Elwakil | |
| 6,194,058 B1 | | 2/2001 | Isobe et al. | |
| 6,195,453 B1 | | 2/2001 | Simonoff | |
| 6,419,987 B1 | * | 7/2002 | Bauer et al. | 427/302 |
| 2002/0015902 A1 | * | 2/2002 | Yau et al. | 430/14 |

FOREIGN PATENT DOCUMENTS

| | | | |
|---|---|---|---|
| EP | 0661169 A1 | | 12/1994 |
| JP | 2002-49318 | * | 2/2002 |

OTHER PUBLICATIONS

Technical Tips, SilverEdge Systems Software, Inc., http://www.silveredge.com/techtips.htm.

An Overview of Media Technology, Sony, Media Solutions.

Metal Evaporated Tape, Sony, http://www.sony.co.jp/en/Products/METape/eng.html.

* cited by examiner

*Primary Examiner*—Monica S. Carter

(57) ABSTRACT

The present invention relates to a magnetic printing media that is used in a laser or inkjet printer. The magnetic printing media is comprised of at least three layers, including a base layer, at least one magnetic layer, and at least one ink receptive layer. Magnetically encoded information is recorded onto the magnetic layer(s), while text and graphics are printed onto the ink receptive layer(s). In a preferred embodiment, the magnetic printing media is used to verify the authenticity of a document. In an alternate embodiment, the magnetic printing media is used to record additional information that is protected from view and from photocopying.

19 Claims, 1 Drawing Sheet

MAGNETIC PRINTING MEDIA FOR INKJET AND LASERJET

FIELD OF THE INVENTION

The present invention generally relates to print media and, in particular, to a magnetic printing media for use in laser and inkjet printers.

BACKGROUND OF THE INVENTION

Magnetic recording media are used to store information such as sound, video images, and computer data. Common magnetic recording media include tapes, disks, drums, cards, and strips and are used in video tapes, audio tapes, computer disks, and cards that store personal information (e.g., credit cards). Magnetic recording media are typically prepared by coating a non-magnetic support with magnetic particles having of pure metals or metal oxides, a technique that is commonly referred to as metal particle technology. The magnetic particles are adhered to the support by a binder or glue. Since the coating contains binder, fewer magnetic particle are present, which reduces the amount of information that can be recorded on the magnetic recording media. As technology progressed, the need for higher capacity magnetic recording media increased. For these applications, metal evaporated technology was developed. In contrast to metal particle technology, the magnetic metal is heated, evaporated in a vacuum, and deposited onto the support. This technique does not require binder and, therefore, the resulting magnetic layer contains more magnetic particles and is able to store more information.

In addition to storing information on magnetic recording media, magnetic particles are used to encode information onto printed documents. As disclosed in U.S. Pat. No. 4,114,032 issued to Brosow et al., magnetic fibers have been used in documents such as paper currency, credit cards, and identification cards to verify the authenticity of the document. Magnetic particles have also been added to printer inks by incorporating the particles into an ink base that includes pigments or dyes, solvents, and water. The magnetic ink is used to verify that the document is an original, as disclosed in U.S. Pat. No. 4,186,944 issued to Pearce. Another common use of magnetic ink is in magnetic image character recognition (MICR) technology, which is used by the banking industry to print information on checks. The printed, magnetic characters identify the issuing bank, the payer=s account number, and routing numbers used by the bank. The magnetic particles in the characters orient an optical device to the location of the information so that the information can be scanned.

However, magnetic inks are not well suited for all applications. For example, magnetic particles are not compatible with all printing processes or inks because the particles precipitate and clog the printer nozzle. In addition, the amount of information that can be magnetically encoded is limited by the amount of magnetic ink printed on the document. The amount of encodable information is further limited because magnetic ink only contains small amounts of magnetic particles. Finally, magnetic ink is easily damaged by water exposure, scratches, or smearing because the ink is printed on an exposed surface of the document.

Use of inkjet magnet sheets are also known in the art. One such example sold by Xerox consists of a magnetic paper that is designed to receive ink from an inkjet printer and be placed on a metal surface, such as a refrigerator, for display of the printed image. These inkjet magnet sheets, however, do not include a magnetically encodable layer of material.

SUMMARY OF THE INVENTION

The present invention relates to a magnetic printing media that is used in a printer. The magnetic printing media is comprised of at least three layers, including a base layer, at least one magnetic layer, and at least one ink receptive layer. Magnetically encoded information is recorded onto the magnetic layer(s), while text and graphics are printed onto the ink receptive layer(s). In a preferred embodiment, the magnetic printing media is used to verify the authenticity of a document. In an alternate embodiment, the magnetic printing media is used to record additional information that is not visible and is protected from photocopying.

DESCRIPTION OF THE DRAWINGS

By way of example, particular embodiments of the invention will be described with reference to the accompanying drawings, in which like parts have the same index numerals in which.

DETAILED DESCRIPTION OF THE INVENTION

The present invention relates to a magnetic printing media that can be used in a printer, such as, for example, an inkjet printer or a laser printer. The magnetic printing media records magnetically encoded information and printed information, such as text and graphics.

Figure 1:
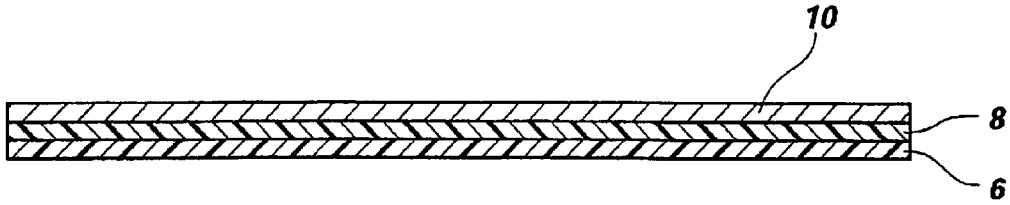
FIG. 1 shows a side view of the three layers of the magnetic printing media.

Referring to FIG. 1, the magnetic printing media 2 is comprised of three layers: a base layer 6, a magnetic layer 8, and an ink receptive layer 10. Preferably, the magnetic printing media 2 is the size of a typical print media, such as paper commonly used in commercially-available printers (e.g, 8½"×11" paper, A4 paper, and 8½"×14" paper). However, it is understood that the magnetic printing media 2 can be of any size that can be accommodated by any printer.

The base layer 6 supports the upper layers of the magnetic printing media 2 and allows the media to be transported through the printing and encoding processes. Base layers are well known in the art and are commonly comprised of cellulose esters, cellulose acetate propionate or cellulose acetate butyrate, polyesters, polyamides, polycarbonates, polyimides, polyolefins, poly(vinyl acetals), polyethers, polyvinyl chloride, polysulfonamides, baryta paper, polyethylene-coated paper, polypropylene synthetic paper, voided polyester, voided polypropylene polyester, cloth, cotton, cotton polyester blends, Mylar®, Tyvek®, polyester laminated paper, plain printer paper, plain copy paper, leather, or canvas.

Alternatively, the base layer 6 may consist of a print media such that the magnetic printing media 2 contains two surfaces that are ink-absorbant and upon which images can be printed. This base layer 6 may include any print media known in the art or any media that is coated to make it ink receptive, as described hereafter with reference to ink receptive layer 10. In yet another alternative embodiment, the base layer 6 may be coated with a material or materials to increase the receptivity of ink on the base layer 6.

The magnetic layer 8 of the present invention is magnetically encodable and is comprised of pure metals, metal alloys, or metal oxides known in the art. The magnetic layer 8 is preferably double sided so that magnetic information may be recorded onto both sides of the layer. Representative magnetic materials suitable for use with the present invention include, but are not limited to, Fe, Co, Ni, Fe—Co, Co—Ni, Fe—Ni, Fe—Co—Ni, Fe—Cu, Co—Cu, Co—Au, Co—Pt, Mn—Bi, Mn—Al, Fe—Cr, Co—Cr, Ni—Cr, Fe—Co—Cr, Co—Ni—Cr, Fe—Co—Ni—Cr, $CrO_2$, $Fe_2O_3$, $Fe_3O_4$, $MnFe_2O_4$, $NiFe_2O_4$, $MgFe_2O_4$, $ZnFe_2O_4$, $CuFe_2O_4$, $CoFe_2O_3$, $CoFe_3O_4$, $CoFe_2O_4$, and Al—Ni—Co.

Figure 2:
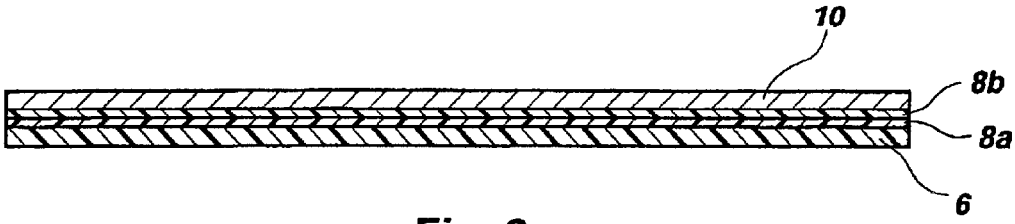
FIG. 2 is a side view of an alternate embodiment of the magnetic printing media.

The magnetic layer 8 is prepared by any technique known in the art including, but not limited to, metal particle technology and metal evaporated technology. Preferably, the magnetic layer 8 is a layer of homogenous, magnetic material. However, the magnetic layer 8 may also include multiple layers of magnetic materials so that a magnetic material incompatible with the printing processes or inks may be used. As shown in FIG. 2, the incompatible magnetic material layer 8*a* can be sandwiched between the base layer 6 and another magnetic layer 8*b* so that it is isolated from the ink receptive layer 10.

The ink receptive layer 10 of the magnetic printing media 2 is capable of receiving printed images by absorbing ink deposited by a printer. The printer is preferably a laser or inkjet printer, although any printing apparatus designed to deposit ink on a medium can be used with the present invention. Many different ink materials may be used in producing printed images on the ink receptive layer 10 of the magnetic printing media 2. In this regard, the invention shall not be restricted to the generation of images using any particular ink product. However, at a minimum, the selected ink composition will include an ink vehicle and at least one coloring agent, with the term "coloring agent" being defined to encompass a wide variety of different dye materials and colors, including black, shades thereof, and/or a combination of various colors and black.

The printed images are text, graphics, or any combination of text and graphics. The ink receptive layer 10 includes a printable surface like that found in various print media known in the art, such as printer paper, copy paper, or a media that is coated with a material that improves ink receptivity. Such coatings to improve the ink receptivity of print media are well known in the art. For example, as disclosed in U.S. Pat. No. 5,916,673 issued to Fryberg et al., print media can be coated with cationic polymers, inorganic pigments, fillers, minerals, metal salts, or metal oxides to increase their ability to absorb ink. Inorganic pigment coatings may also include porous materials, such as alumina and silica pigments, as taught in U.S. Pat. No. 6,183,851 issued to Mishima.

The layers of the magnetic printing media 2 are adhered by any suitable means known in the art so that the relative positions of the printed and magnetically encoded information are fixed. Suitable bonding materials for use with the present invention include, but are not limited to, thermal plastic adhesives, glues, wax adhesives, spray adhesives, and acrylic polymer adhesives.

Figure 3:
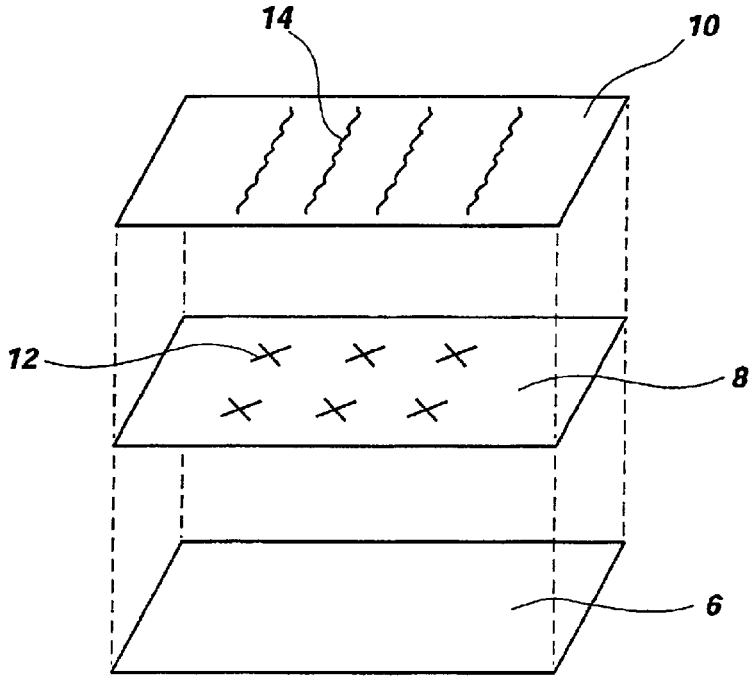
FIG. 3 is an exploded perspective view that depicts the magnetic printing media with different information recorded on the magnetic layer and the ink receptive layer.

In a preferred embodiment, the magnetic printing media 2 is used to verify that a particular document is authentic. As shown in FIG. 3, an image 12 (e.g., a design, signature, and/or text) is magnetically encoded onto the magnetic layer 8 while printed information 14 is printed onto the ink receptive layer 10. The resulting magnetic printing media 2 contains the magnetically encoded image 12 positioned between the base layer 6 and the ink receptive layer 10. The magnetic image 12 is similar to a watermark because a recipient of the document is able to verify whether the document is authentic by determining if the magnetic image 12 is present. If the magnetic image 12 is not present or an incorrect magnetic image 12 is present, the recipient knows that the document is not authentic.

The magnetic layer 8 and ink receptive layer 10 may each contain different or identical information. For instance, as depicted in FIG. 3, the magnetic image 12 may be encoded onto the magnetic layer 8 while the ink receptive layer 10 contains different printed information 14. Alternatively, the same information may be recorded (duplicated) on both layers, with the magnetic layer 8 containing a magnetically encoded copy of the text and images printed on the ink receptive layer 10. In this fashion, the information contained in the magnetic printing media 2 may be read by an apparatus adapted to read the magnetic image 12 contained in the magnetic layer 8 and/or may be read by man or machine by optically reading the printed information 14 contained on the ink receptive layer 10. The printed information 14 contained on the ink receptive layer 10 can include information that directs the apparatus or device that reads the magnetic image 12 to particular points or sections within of the magnetic layer 8. The information contained on the ink receptive layer 10 may also be used to instruct the apparatus or device reading the magnetic image 12 to read the magnetic image 12 in a specific order or direction. In similar fashion, the information contained magnetic layer 8 can be used to direct an apparatus or device to specific sections or parts of the ink receptive layer or instruct such an apparatus to read printed information 14 in a specific order or direction.

The information on each layer can be recorded simultaneously or at different times. The magnetic information and printed text may be recorded simultaneously by a device that has been modified to record magnetic information and print text and graphics. Alternatively, the information may be recorded at different times by recording the magnetic information onto the magnetic printing media 2 and then feeding the magnetic printing media 2 through the printer.

The magnetically encoded information on the magnetic printing media 2 may be read by a device designed for such use, such as an apparatus that contains magnetic heads. Devices suitable for reading magnetically encoded information are well known in the art and include tape recorders, video cassette recorders, disk drives, and magnetic card readers. These magnetic reading devices may be modified so that the encoded magnetic information can be read. Possible modifications include modifying the magnetic heads so that the magnetically encoded information can be read as an entire sheet, from left to right, line-by-line, or in its entirety (i.e., reading the entire page at once).

For applications requiring more sophisticated verification, such as whether a specific magnetic image 12 is present, the devices can be modified to detect the exact location of magnetic particles or the density of the magnetic particles.

The magnetic printing media 2 of the present invention has numerous advantageous over the prior art. First, the magnetic layer 8 is more durable. Since the magnetic layer 8 is located between the base layer 6 and ink receptive layer 10, it is not damaged by water exposure, scratches, or smearing. Second, since magnetic particles are located over the entire surface of the magnetic printing media 2, the magnetic layer 8 is able to record more information. Therefore, more intricate images, which would be harder to copy, can be encoded onto the magnetic layer 8. Third, different types of information can be recorded on the magnetic printing media 2 because it can receive both magnetically encoded information and printed text and graphics.

Figure 4:
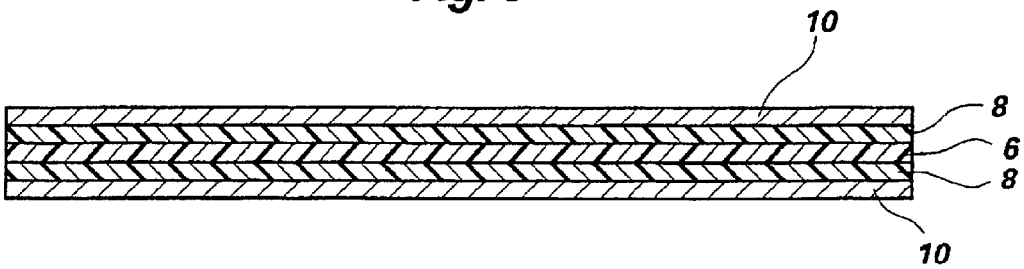
FIG. 4 is a side view of an alternate embodiment of the magnetic printing media.

In an alternate embodiment, the magnetic printing media 2 provides an additional layer of information in comparison to a printed document. The magnetic printing media 2 contains at least two layers, the magnetic layer 8 and the ink receptive layer 10, that can record information. These two layers record different types of information, thus increasing the amount, type, and/or versatility of information contained in the magnetic printing media. In comparison, the standard printed document only records printed information. In a preferred embodiment of the present invention, the base layer 6 of the present invention is a print media known in the art and the magnetic layer 8 is double-sided and encodable on both of its surfaces. This advantageously provides the magnetic printing media 2 with two surfaces on which text and graphics may be printed in magnetic and/or optical (i.e., ink/print) formats. As illustrated in FIG. 4, the magnetic printing media 2 can include two magnetic layers 8 and two ink receptive layers 10. This particular embodiment permits information to be encoded on one or both magnetic layer(s) 8 and/or printed on one or both ink receptive layer(s) 10, thus permitting the user to print or magnetically encode images, text, or other information on one or both sides of the magnetic printing media 2.

Magnetic particles in the magnetic layer 8 are located over the entire surface of the magnetic printing media 2, so the magnetic layer 8 is able to record more information than can be recorded through use of magnetic inks. The information recorded in the magnetic layer 8 is not visible, so sensitive information is protected from view. In addition, since the information stored on the magnetic layer 8 is not visible, it is protected from photocopying. However, the images printed on the ink receptive layer 10 are still easily photocopied by means known in the art. Therefore, sensitive material may be magnetically encoded onto the magnetic printing media 2 while still allowing easy photocopying of the printed information.

The magnetic printing media 2 of the present invention is advantageous over the prior art because additional information is encodable onto the magnetic layer 8. Since magnetic particles are located over the entire surface of the magnetic printing media 2, rather than limited to the narrow dimensions of magnetic tape or the locations of magnetic ink, the magnetic layer 8 is able to record more information. In addition, different types of information can be present on the magnetic printing media 2 because it can record both printed text and magnetically encoded information. Finally, since magnetic particles that are incompatible with the inks or printing process can be isolated in a separate layer, the present invention is more versatile than prior art media and methods relying on single layers of material to receive both ink and magnetic particles on the same surface.

Having set forth preferred embodiments of the present invention, it is anticipated that suitable modifications may be made thereto by individuals skilled in the art which nonetheless remain within the scope of the invention. For example, the invention shall not be limited to any particular ink compositions, printing technologies, adhesives, and material layers used to manufacture the magnetic printing media. In this regard, the present invention shall only be construed in accordance with the following claims.

What is claimed is:

1. A magnetic printing medium for use in a laser and inkjet printer comprising:

a base layer;

at least one magnetic layer in contact with the base layer, wherein the at least one magnetic layer comprises a layer of homogenous, magnetic material upon which magnetically encoded information is recorded; and at least one ink receptive layer in contact with the at least one magnetic layer, wherein the at least one ink receptive layer absorbs laser ink or inkjet ink thereon.

2. The magnetic printing medium of claim 1, wherein the base layer supports the magnetic printing medium and allows the magnetic printing medium to be transported through either of the laser printer or the inkjet printer.

3. The magnetic printing medium of claim 1, wherein the base layer comprises a printable surface, the at least one magnetic layer comprises one magnetic layer in contact with the base layer, and the at least one ink receptive layer comprises one ink receptive layer in contact with the one magnetic layer.

4. The magnetic printing medium of claim 3, wherein the at least one ink receptive layer comprises a surface that is coated onto the at least one ink receptive layer to increase the ink receptivity of the surface.

5. The magnetic printing medium of claim 1, wherein the magnetic printing medium receives ink on the at least one ink receptive layer and the base layer.

6. The magnetic printing medium of claim 1, wherein the at least one magnetic layer is comprised of a magnetic material selected from the group consisting of Fe, Co, Ni, Fe—Co, Co—Ni, Fe—Ni, Fe—Co—Ni, Fe—Cu, Co—Cu, Co—Au, Co—Pt, Mn—Bi, Mn—Al, Fe—Cr, Co—Cr, Ni—Cr, Fe—Co—Cr, Co—Ni—Cr, Fe—Co—Ni—Cr, $CrO_2$, $Fe_2O_3$, $Fe_3O_4$, $MnFe_2O_4$, $NiFe_2O_4$, $MgFe_2O_4$, $ZnFe_2O_4$, $CuFe_2O_4$, $CoFe_2O_3$, $CoFe_3O_4$, $CoFe_2O_4$ and Al—Ni—Co.

7. The magnetic printing medium of claim 1, wherein the magnetically encoded information comprises text.

8. The magnetic printing medium of claim 1, wherein the magnetically encoded information comprises textual and graphical information.

9. The magnetic printing medium of claim 1, wherein the at least one magnetic layer is adhered to the base layer and the at least one ink receptive layer is adhered to the at least one magnetic layer.

10. A magnetic printing medium used to verify the authenticity of a document, comprising:

a base layer;

at least one magnetic layer upon which magnetically encoded information is recorded, the at least one magnetic layer comprising a layer of homogenous, magnetic material, wherein the at least one magnetic layer is adhered to the base layer; and at least one ink receptive layer upon which printed information is recorded, wherein the at least one ink receptive layer absorbs laser ink or inkjet ink, wherein the at least one ink receptive layer is adhered to the at least one magnetic layer, and wherein the authenticity of the document is verified by determining whether the magnetic layer contains the magnetically encoded information.

11. The magnetic printing medium of claim 10, wherein the magnetically encoded information comprises a magnetic image.

12. The magnetic printing medium of claim 10, wherein the magnetically encoded information is identical in content to the printed information.

13. The magnetic printing medium of claim 10, wherein the at least one magnetic layer and the at least one ink receptive layer record encoded information and printed information simultaneously.

14. The magnetic printing medium of claim 10, wherein the magnetic layer and the ink receptive layer record encoded information and printed information at separate times.

15. The magnetic printing medium of claim 10, wherein the base layer comprises a printable surface, the at least one magnetic layer comprises one magnetic layer in contact with the base layer, and the at least one ink receptive layer comprises one ink receptive layer in contact with the one magnetic layer.

16. The magnetic printing medium of claim 15, wherein the printable surface of the base layer comprises a coated surface that increases ink receptivity on the base layer.

17. A method of making a magnetically encoded, printed document comprising:

providing a base layer that supports a magnetically encoded printed document;

adhering a magnetic layer to the base layer;

adhering an ink receptive layer to the magnetic layer;

recording magnetically encoded information on the magnetic layer; and printing information on the ink receptive layer using an inkjet printer or a laser printer.

18. The method of claim 17, wherein recording magnetically encoded information comprises transporting the magnetically encoded, printed document through a magnetic recording device.

19. The method of claim 17, wherein printing information comprises transporting the magnetically encoded, printed document through the inkjet printer or the laser printer.

* * * * *